United States Patent [19]

Kotnik

[11] Patent Number: 4,617,710

[45] Date of Patent: Oct. 21, 1986

[54] INSULATOR REMOVAL TOOL

[75] Inventor: Ernest J. Kotnik, Northwood, Ohio

[73] Assignee: AP Industries, Inc., Toledo, Ohio

[21] Appl. No.: 738,767

[22] Filed: May 29, 1985

[51] Int. Cl.[4] ..... B25B 27/00

[52] U.S. Cl. ..... 29/268; 81/381; 81/419

[58] Field of Search ..... 29/268; 81/418, 424.5, 81/426, 426.5, 367-381, 383, 419

[56] References Cited

U.S. PATENT DOCUMENTS

| | | | |
|---|---|---|---|
| 827,392 | 7/1906 | Prangemeier . | |
| 851,794 | 4/1907 | Bernard . | |
| 1,316,409 | 9/1919 | Bahre . | |
| 1,326,858 | 12/1919 | Glasscock . | |
| 2,399,454 | 4/1946 | Snell | 81/377 |
| 2,543,922 | 3/1951 | Mead | 81/369 |
| 2,700,910 | 2/1955 | Van Niel | 29/268 |
| 2,952,173 | 9/1960 | Fexas . | |
| 3,017,692 | 1/1962 | Burnell | 29/268 X |
| 3,657,948 | 4/1972 | Myers | 81/367 |
| 3,823,462 | 7/1974 | Kanda | 29/268 |
| 3,924,507 | 12/1975 | Faroni . | |
| 3,991,635 | 11/1976 | Maroni | 29/268 X |
| 4,170,125 | 10/1979 | Minka | 29/268 X |
| 4,179,782 | 12/1979 | Forman et al. | 29/268 |
| 4,222,985 | 9/1980 | Greenleaf | 29/268 X |
| 4,457,306 | 7/1984 | Borzone | 81/426.5 X |

FOREIGN PATENT DOCUMENTS

| | | | |
|---|---|---|---|
| 156220 | 7/1953 | Australia | 81/379 |
| 738767 | 10/1972 | United Kingdom . | |

*Primary Examiner*—Frederick R. Schmidt
*Assistant Examiner*—Steven P. Schad
*Attorney, Agent, or Firm*—Anthony J. Casella; Gerald E. Hespos

[57] ABSTRACT

A tool for urging an enlarged head of a vehicular exhaust system mounting stud from an insulator. The tool includes a driver having a driving shaft for contacting the enlarged head and applying forces thereto. The tool also includes a support pivotally mounted to the driver. The support includes a pair of spaced apart arms. The arms define first and second supporting surfaces. The supporting surfaces are angularly aligned relative to one another such that the first and second support surfaces can be used sequentially for urging the enlarged head completely through the insulator.

10 Claims, 8 Drawing Figures

INSULATOR REMOVAL TOOL

BACKGROUND OF THE INVENTION

Vehicular exhaust systems comprise one or more exhaust pipes extending from manifolds on the engine, one or more mufflers connected to the exhaust pipes and at least one tailpipe extending from the muffler. Vehicles may also include antipollution devices, such as catalytic converters, incorporated into the exhaust system. The exhaust system may circuitously extend 10 to 20 feet from the engine to the rear end of the vehicle. On certain trucks, the exhaust system may extend even further.

The various components of the exhaust system are suspended from the underside of the vehicle. In the past, this mounting of the exhaust system has been accomplished with metallic bracket assemblies which typically would include bolts, nuts and a variety of support members. Recently, however, some vehicular manufacturers have been utilizing rubber insulators into which metallic studs are mounted. The insulators are solid rubber members that typically are between one inch and one and five-eights inches thick. Each insulator usually will include two generally circular apertures extending entirely therethrough for receiving two studs.

Each stud is a generally cylindrical metallic member that may be bent into an appropriate configuration for mounting on a particular vehicle. The cylindrical body of the stud has a diameter substantially equal to the diameter of the apertures extending through the insulator. The stud also includes an enlarged head. The juncture between the head and the cylindrical body defines a shoulder which extends outwardly and generally perpendicular to the outer cylindrical surface of the stud body. The extreme end of the head generally perferably is tapered down to a dimension that is equal to or smaller than the diameter of the apertures through the insulator.

In use, the tapered head is forced entirely through an aperture in the insulator. This can be accomplished fairly easily because the tapered configuration of the head causes the insulator to deform as the stud is pushed therethrough. However, once the enlarged head of the stud emerges from the opposite side of the insulator, the entire insulator will return to its initial shape with the diameter of the aperture in the insulator substantially conforming to the diameter of the stud body. The outwardly extending shoulder of the enlarge head adjacent to the stud body will be significantly larger than the aperture in the insulator. Thus, the stud cannot easily become disengaged from the insulator.

One of the studs inserted in an insulator, as explained above, is attached to an appropriate supporting structure on the vehicle. Another similar stud inserted in the insulator is attached to an appropriate part of the vehicular exhaust system. Thus, the combination of studs and rubber insulator are utilized to hold the exhaust system to the vehicle. This combination is believed to be less expensive than many prior art metallic mounting structures, is not susceptible to rusting, is inexpensive and may function to dampen certain exhaust system vibrations from the vehicular body.

Despite the apparent advantages of mounting exhaust systems with rubber insulators, and despite the wide spread acceptance of rubber insulators, it has now been found that these insulators make repairs and replacements to the vehicular exhaust system very difficult.

Specifically, the enlarged head cannot readily be removed from the rubber insulator. This difficulty is caused by the outwardly extending shoulder at the juncture between the enlarged head and the body of the stud. This outwardly extending shoulder is not tapered like the opposed side of the head. Therefore the shoulder edge of the enlarged head cannot readily make its initial entry into the apertures in the insulator to cause a gradual expansion of the insulator adjacent thereto.

Vehicular maintanance personnel have resorted to several largely undesirable techniques for a replacing exhaust systems mounted with the above described rubber insulators and metallic studs. One common approach has involved cutting the metallic stud intermediate the insulator and the exhaust system component to which the stud is mounted. This approach generally takes an inordinate amount of time and requires the use of cutting tools in rather closely confined spaces. Furthermore, this approach often requires the rewelding of the stud to the vehicular body. This rewelding in close proximity to other parts of the vehicle can be damaging to the vehicle and dangerous to the worker.

Other vehicle maintenance personnel have attempted to use knives, razors or the like to cut the insulator from the stud. This approach also can be quite dangerous due to the use of a sharp instrument on a very tough resilient object in a closely confined space. Furthermore, even if this approach is successful, it results in the destruction of a functional insulator.

Still other workers attempt to remove the stud from the insulator by using screwdrivers, chisles, hammers and the like to forcibly urge the stud through the aperture in the insulator. Again, these attempts are time consuming, awkward and potentially dangerous.

Several hand tools have been developed for mounting one member to another or for removing a member from another. None of these known tools, however, would be at all helpful in removing a stud from an insulator as described above. For example, U.S. Pat. No. 3,823,462 which issued to Kanda on July 16, 1974 shows a hand tool for removing a broken component from a sprinkler system. The tool shown in U.S. Pat. No. 3,823,462 shows a first tool portion circumferentially engaging the outer surface of a first part of the sprinkler system and a second tool portion for pulling the broken part of the system therefrom.

U.S. Pat. No. 4,170,125 which issued to Minka on Oct. 9, 1979 shows a plier-like tool for crimping ferrules onto conduits.

U.S. Pat. No. 3,017,692 which issued to Burnell on Jan. 23, 1962 shows another plier-like tool for circumferentially surrounding a cylindrical spring clip to close that clip around a pin or post.

U.S. Pat. No. 1,316,409 issued to Bahre on Sept. 16, 1919 and shows another simple plier-like tool for extracting cotter pins. A very similar tool is shown in U.S. Pat. No. 1,326,858 which issued to Glasscock on Dec. 30, 1919.

Still other hand tools similar to those decribed above are shown in U.S. Pat. No. 851,794 which issued to Bernard on Apr. 30, 1907; U.S. Pat. No. 827,392 which issued to Prangemeier on July 31, 1906; U.S. Pat. No. 2,700,910 which issued to Van Niel on Feb. 1, 1955; U.S. Pat. No. 2,952,173 which issued to Fexas on Sept. 13, 1960; U.S. Pat. No. 3,924,507 which issued to Faroni on Dec. 9, 1975; U.S. Pat. No. 3,991,635 which issued to Marone on Nov. 16, 1976; U.S. Pat. No. 4,179,782 which issued to Forman et al on Dec. 25, 1979; U.S. Pat. No. 4,222,985 which issued to Greenleaf on Dec. 16, 1980; and British Pat. No. 1,293,158 which issued to Murphy et al on Oct. 18, 1972.

As noted above, none of these known tools suggest any way to remove the above described stud having an enlarged head from the rubber insulator described above.

In view of the above, it is an object of the subject invention to provide a tool for removing a mounting stud from an insulator of a vehicular exhaust system.

It is another object of the subject invention to provide a tool that can be easily and efficiently used on insulators of any of a variety of configurations.

It is a further object of the subject invention to provide a tool for removing mounting studs from insulators that does not require the use of other tools simultaneously.

Is an additional object of the subject invention to provide a tool for removing mounting studs from insulators that is safe to use.

SUMMARY OF THE INVENTION

The subject invention is directed to a tool having a support means for mounting against the insulator and a driving means for urging the enlarged head of a stud through the aperture in the insulator. The support means and the driving means are pivotally connected to one another and are mounted to handles for effecting the movement of the support means and the driving means.

The support means preferably defines a fork-shaped end configured to mount against the side of the insulator opposite the enlarged head of the stud. The fork-shaped end preferably is defined by a pair of arms that are spaced apart a distance greater than the diameter of the stud. In a prefered embodiment, explained in detail below, the forked end of the support means includes first and second support surfaces. The two support surfaces are disposed relative to one another such that the first surface is employed for the initial movement of the stud head into the insulator. The second support surface then can be repositioned relative to the insulator to guide the stud the remainder of the distance through the insulator. This second surface also can be utilized for narrow insulators.

The driving means can define an elongated shaft the diameter of which is less than the diameter of the aperture through the insulator. The extreme end of the shaft preferably is configured to engage the extreme tapered end of the enlarged head of the stud. The shaft can be removably mounted to the driving means.

The support means and the driving means preferably are pivotally connected to one another. To achieve the proper angular movement therebetween, the support and driving means can be connected through a pivoting linkage structure. Specifically, in the prefered embodiment, the support means is pivoted to both a portion of the driving means handle and to a second handle. A linkage means also is pivotally connected to both the driving means handle and the second handle. This linkage limits and defines the relative pivotal movement between the support means and the driving means. The spacing between the various pivot points at least partly controls the spacing between the extreme ends of both the support and driving means.

The tool of the subject invention is utilized by moving the respective handles to urge the driving means into a position where it is furthest from the support means. The support means then is positioned against the insulator such that the spaced apart arms thereof are disposed on opposite sides of the stud to be removed. Preferably the insulator is disposed against the first support surface of the support means. The handles of the tool then are advanced toward one another such that the extreme end of the driving means engages the tapered surface of the enlarged head on the stud. The handles are closed further, causing the driving means to advance toward the support means, and thereby urging the enlarged head into the aperture in the insulator. More particularly, the force of the driving means against the stud causes the enlarged head thereof to expand the portion of the insulator adjacent the aperture therethrough.

The above described driving force on the enlarged head causes the stud to move easily about half way through the insulator. However, at approximately the half way point, the angular relationship between the first support surface of the support means and the shaft of the drive means causes the driving means to urge the stud at an angle to the axis of the aperture through the insulator. Thus, continued movement of the driving means becomes increasingly difficult. To overcome this difficulty, the tool may be repositioned such the insulator is engaged by the second support surface of the support means. The angular relationship between this second support surface and the driving means is such that continued movement of the driving means can be carried out relatively easily to completely remove the stud from the insulator.

DETAILED DESCRIPTION OF THE PREFERRED EMBODIMENT

Figure 1:
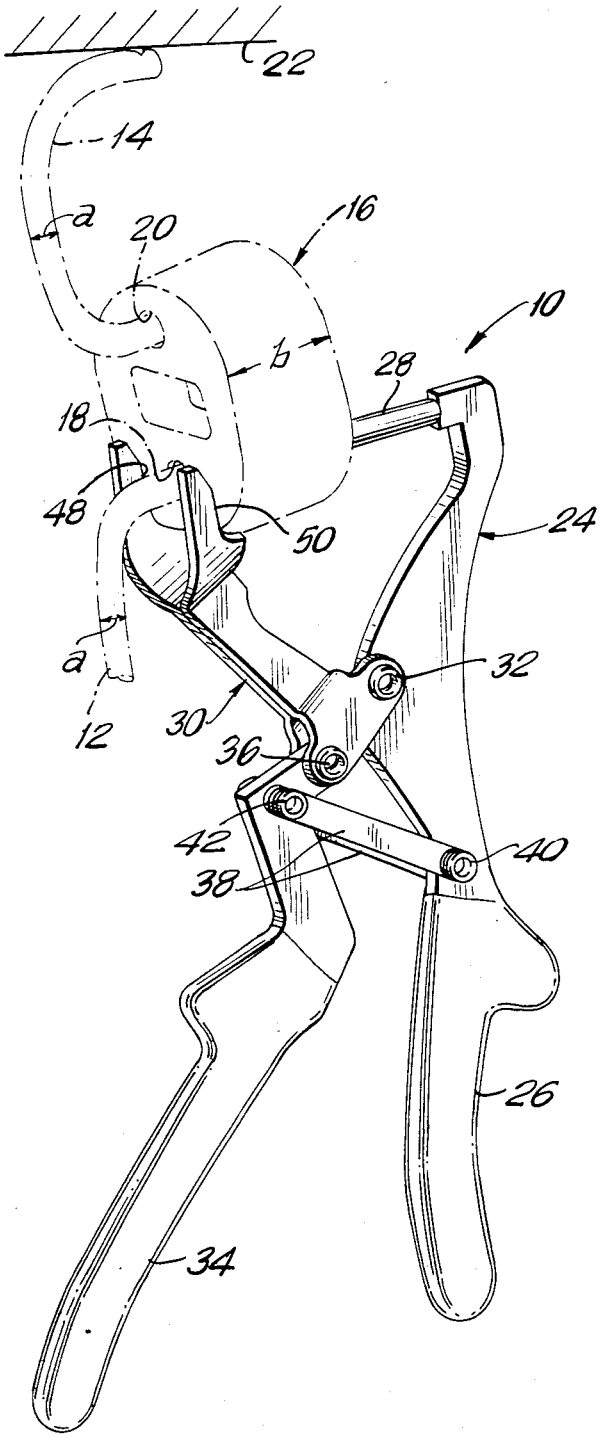
FIG. 1 is a perspective view of the tool of the subject invention used with an insulator and mounting stud assembly.

The insulator removal tool of the subject invention is indicated generally by the numeral 10 in FIG. 1. The tool 10 is specifically adapted to remove studs 12 or 14 from a rubber insulator 16. The studs 12 and 14 may have any of several cross sectional configurations, and may be different from one another. For purposes of this explanation, however, each stud 12 and 14 is described and illustrated as including a cylindrical body portion having a diameter indicated by dimension "a" in FIG. 1 and an enlarged head as shown in FIGS. 5 through 8.

The tool 10 will be equally functional with studs 12 and 14 of other cross-sectional shapes. The cylindrical bodies of the studs 12 and 14 are mounted to apertures 18 and 20 respectively which extend entirely through the insulator 16. The apertures 18 and 20 have diameters substantially equal to or slightly greater than the diameter "a" of the cylindrical bodies of the studs 12 and 14. Insulator 16 may assume any of several sizes and shapes. The typical insulator 16, however, will have a thickness of approximately 1.5 inches as indicated by dimension "b" in FIG. 1.

The studs 12 and 14 and the insulator 16 will be used to mount a portion of an engine exhaust system to a vehicle. For example, as illustrated in FIG. 1, the stud 14 may be welded to a vehicular body 22. Similarly the stud 12 will include a portion secured to an exhaust pipe, a tail pipe, muffler, a catalytic converter or the like.

The tool 10 includes a driver 24 adapted to drive the enlarged head of stud 12 or 14 through the smaller aperture 18 or 20 respectively in insulator 16. The driver 24 is an elongated member having a handle 26 at one end and a driving shaft 28 at the opposed end. As illustrated most clearly in FIG. 4, the driving shaft 28 will have a length "L" which is approximately equal to the thickness "b" of the insulator 16. Preferably the length "L" of driving shaft 28 will be slightly greater than the difference between the thickness "b" of insulator 16 minus the axial length of the enlarged head on stud 12 or 14. Thus, as explained further below, the driving shaft 28 will be long enough to force the enlarged head of stud 12 or 14 to a point where it at least begins to emerge on the opposite side of the insulator 16. The driving shaft 28 includes an annular end 29 which is dimensioned to engage the tapered end of the enlarge head on stud 12 or 14.

Figure 3:
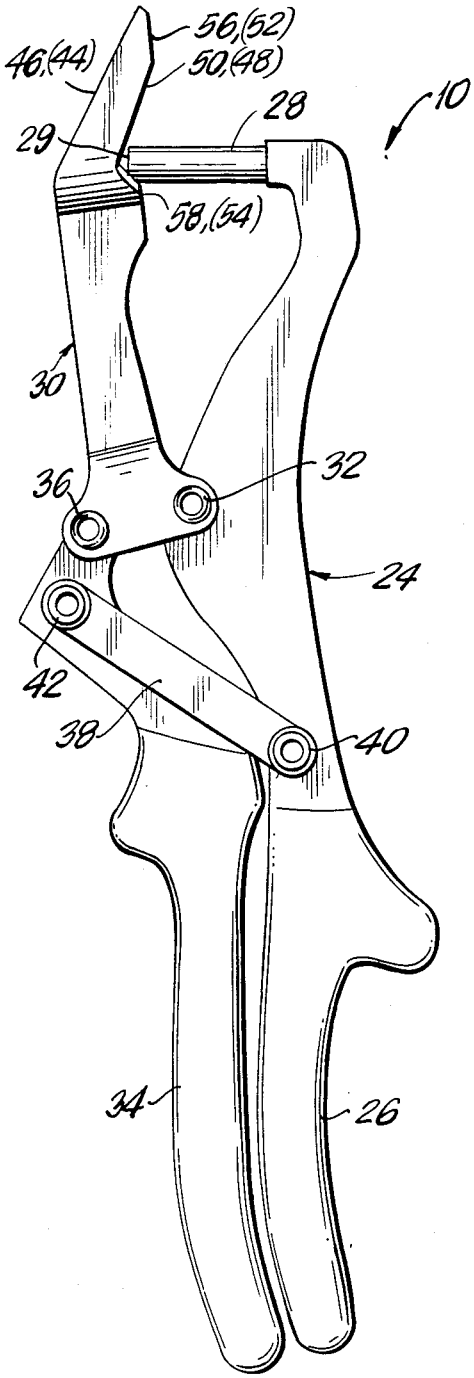
FIG. 3 is a side elevational view of the tool of the subject invention in the closed position.
Figure 4:
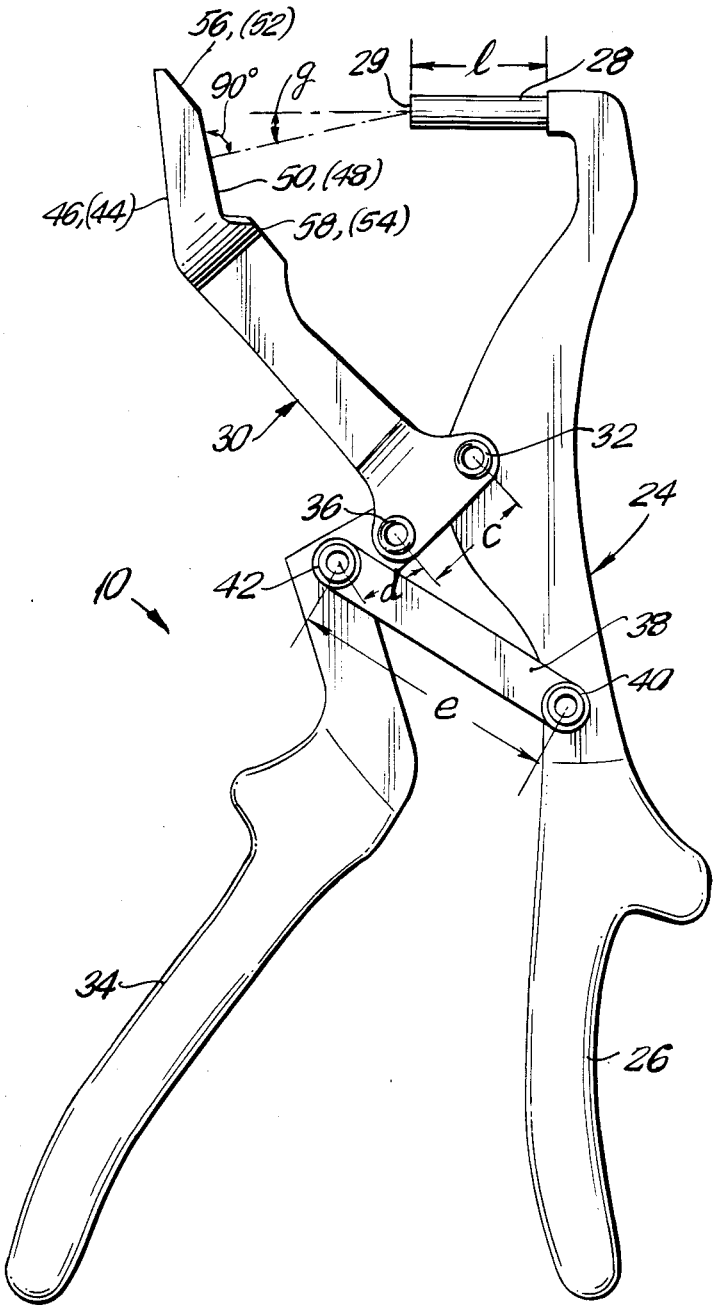
FIG. 4 is a side elevational view of the tool of the subject invention in an open position.

The tool 10 further includes support 30, which is pivotally mounted to the driver 24 at location 32. The tool 10 also includes a second handle 34 which is pivotally connected to the support 30 at location 36. Thus, movement of handle 34 relative to the handle 26 can cause a corresponding movement of support 30. This movement of support 30 in response to movement of handle 34 is assured and carefully controlled by linkage 38. More particularly, the linkage 38 is pivotally mounted to driver 24 at location 40 and is pivotally mounted to handle 34 at location 42. As a result of the above described connections, as illustrated in FIGS. 3 and 4, the movement of handle 34 toward handle 26 causes a pivoting of handle 34 about point 42 and relative to the linkage 38. Thus, a gripping force which urges handles 34 and 26 toward one another will cause pivot point 36 to rotate relative to both pivot pins 32 and 42 and generally away from the handle 26 of driving member 24. This movement of point 36 causes a corresponding pivoting of the support 30 about pivot point 32. This pivotal movement of the support 30 brings the extreme end of the support 30 closer to the driving shaft 28.

Preferably, pivot points 32 and 36 are spaced apart by approximately one inch as indicated by dimension "c" in FIG. 4. Similarly it is preferred that pivot points 36 and 42 be spaced apart by approximately three-quarters of an inch as indicated by dimension "d" in FIG. 4. Finally, it is preferred that the distance between pivot points 40 and 42 be approximately two and three quarter inches as indicated by dimension "e" in FIG. 4. This particular structural arrangement enables a wide opening between driver 24 and support 30 thereby enabling proper mounting to insulator 16 and stud 12 or 14 as shown in FIG. 1. Furthermore, this particular arrangement provides a desirable mechanical advantage for moving the driver 24 and the support 30 through the required distances and with a convenient and easily manageable range of movement for handles 26 and 34.

Figure 2:
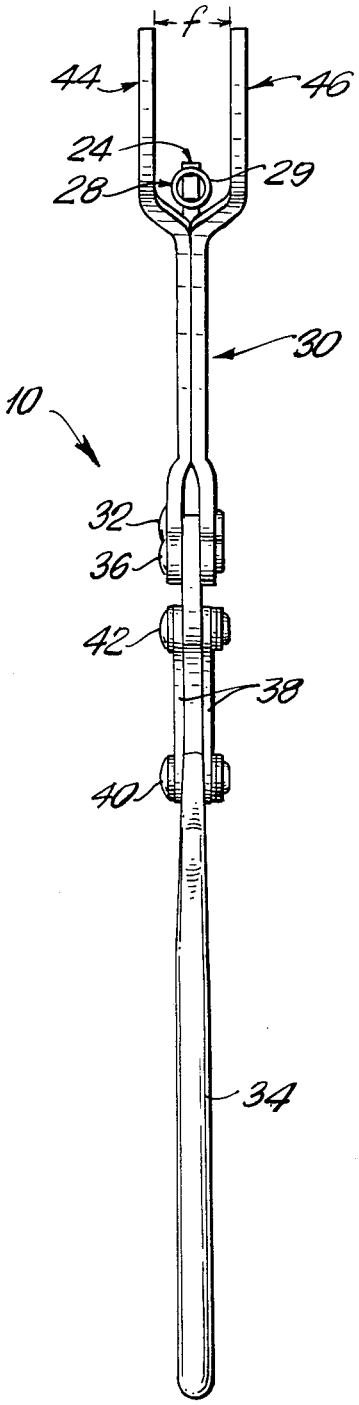
FIG. 2 is a front elevational view of the tool of the subject invention.

The end of support 30 opposite the pivot points 32 and 36 is defined by arms 44 and 46 which are spaced apart by dimension "f" as shown in FIG. 2. The dimension "f" is selected to enable the spaced apart arms 44 to be disposed on opposite sides of a stud 12 or 14, while still being securely mounted to the insulator 16 as shown in FIG. 1. The arms 44 and 46 preferably extend to and are mounted on opposite sides of driver 24 and handle 34 as shown in FIG. 2. This construction ensures proper balance for tool 10.

The arms 44 and 46 include first support surfaces 48 and 50 which are aligned such that as the tool 10 approaches its maximum open position, the first surfaces 48 and 50 are approximately perpendicular to the driving shaft 28, and at the maximum open position first surfaces 48 and 50 will have extended beyond the perpendicular alignment to the driving shaft 28 as indicated by the angle "g" in FIG. 4. Angle "g" preferably is between 15–30 and most preferably is about 20. Angles "g" greater than this range tend to drive the stud 12 too much into the rubber of insulator 16 and not sufficiently along the axis of aperture 18. Conversely angles "g" which are smaller do not sufficiently stretch the opening of aperture 18 and have a limited range of movement.

The arms 44 and 46 also are provided with second support surfaces defined by locations 52 and 54 on arm 44 and by locations 56 and 58 on arm 46. The locations 52–58 define a common plane which, when the tool 10 is in its closed condition, is approximately perpendicular to the driving shaft 28.

Figure 5:
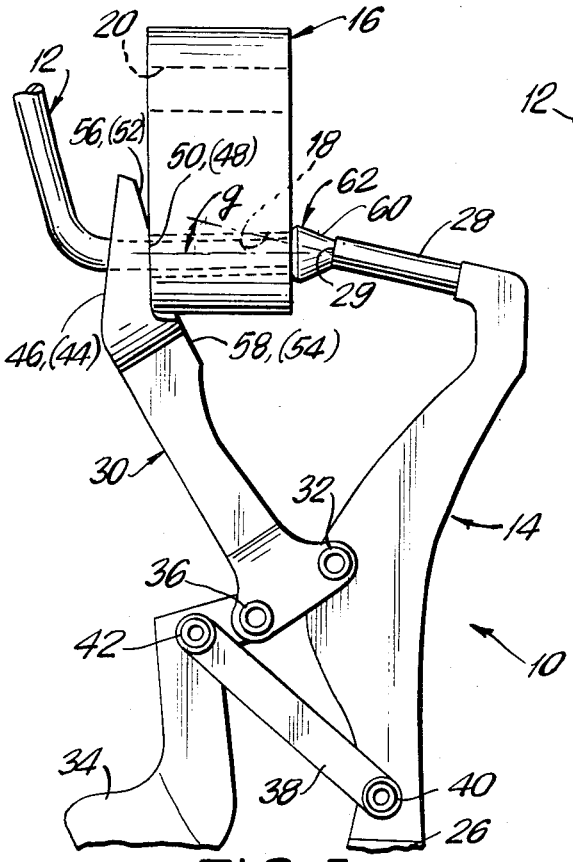
FIG. 5 is a side elevational view of the tool of the subject invention engaging an insulator and mounting stud.

The operation of tool 10 is illustrated in FIGS. 5–8. More particularly, as shown in FIG. 5, the tool 10 is opened to its maximum dimensions such that the arms 44 and 46 are disposed on opposite sides of stud 12, and such that first surfaces 48 and 50 are securely positioned against insulator 16. The annular end 29 of driving shaft 28 then is positioned against the tapered end 60 of the enlarged head 62 on stud 12. In this initial position, as shown in FIG. 5, the driving shaft 28 is angularly aligned to the axis of stud 12 and aperture 18 in insulator 16 by angle "g".

Figure 6:
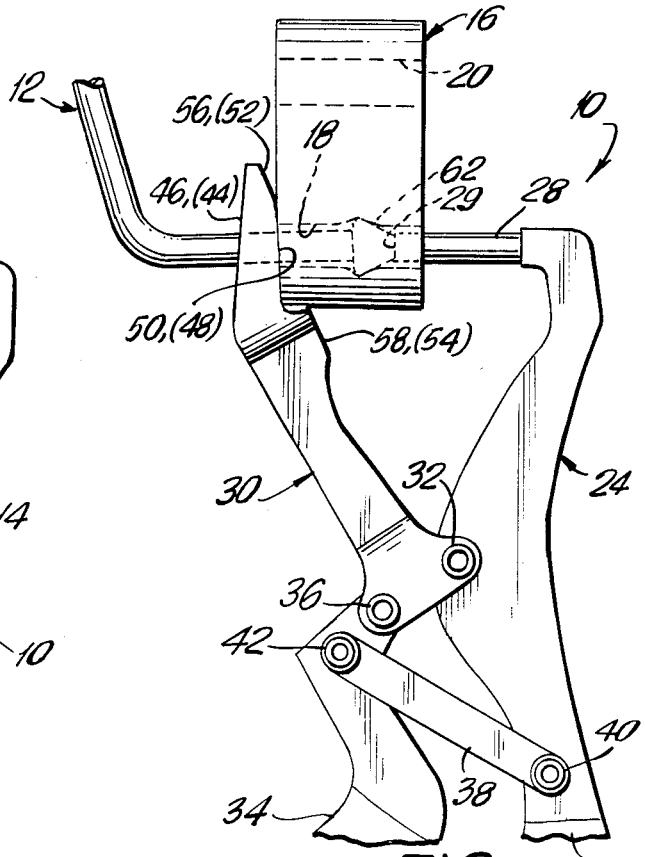
FIG. 6 is a side elevational view of the tool of the subject invention after having partly urged the stud through the insulator.

After the tool 10 has been properly positioned relative to stud 12 and insulator 16, the user of tool 10 begins urging handles 34 and 26 toward one another. As explained above, this movement of handles 34 and 26 causes relative rotation of support 30 and driver 24 about pivot point 32. This initial movement of the support and driver 30 and 24 toward one another not only urges the stud 12 along aperture 18, but also causes a relative angular movement of stud 12 relative to the aperture 18. This angular movement, is caused by the initial angular alignment of driving shaft 28 relative to the aperture 18 as indicated by angle "g" in FIG. 5. As a result of this slightly angular force, insulator 16 deforms at the interface of aperture 18 and the enlarged head 62 of stud 12. This expansion of aperture 18 adjacent the enlarged head 62 when combined with the driving force on stud 12 enables the enlarged head 62 to enter aperture 18 in insulator 16. Continued movement of handles 34 and 26 toward one another gradually brings the driving shaft 28 into generally perpendicular alignment with the first surfaces 48 and 50 of arms 44 and 46 respectively. The movement of stud 12 through aperture 18 becomes easier as driving shaft 28 approaches a collinear alignment with aperture 18 and a perpendicular alignment to first surfaces 48 and 50. This relative alignment is illustrated in FIG. 6. However, as the driving shaft 28 advances beyond the position shown in FIG. 6, the driving shaft 28 begins to drive the enlarged head 62 of stud 12 at an angle to the axis of aperture 18 and into the rubber material of insulator 16. Thus, advancement of driving shaft 28 beyond the position shown in FIG. 6 becomes increasingly more difficult.

Figure 7:
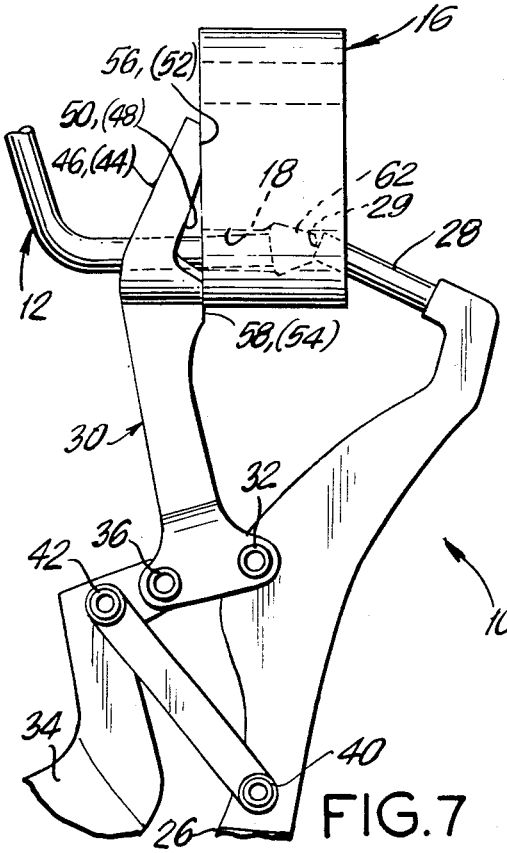
FIG. 7 is a side elevational view of the tool of the subject invention repositioned to complete the removal of the stud from the insulator.
Figure 8:
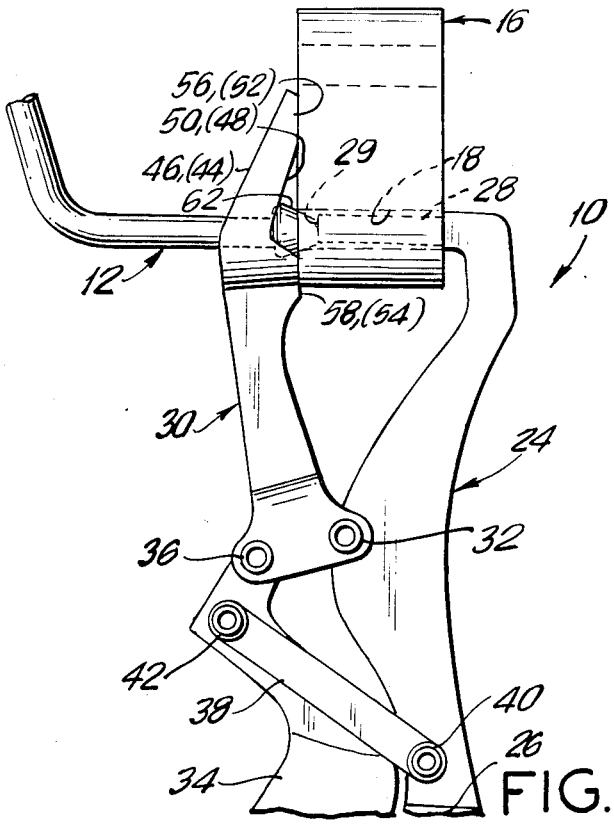
FIG. 8 is a side elevational view of the tool of the subject invention upon complete removal of the stud from the insulator.

To overcome the difficulties encountered as driving arm 28 passes beyond the perpendicular alignment to first surfaces 48 and 50, the tool 10 is opened slightly and the support 30 is repositioned such that the second surfaces 52–58 are mounted against the insulator 16, as illustrated in FIG. 7. In this condition, the angular alignment of the driving shaft 28 to the aperture 18 is similar to the alignment illustrated in FIG. 5. Thus, as explained with respect to FIG. 5, the continued movement of driving shaft 28 caused by movement of handles 34 and 26 gradually pushes the stud 12 and the enlarged head 62 thereof towards an axial movement relative to aperture 18. Consequently, the continued movement of stud 12 through aperture 18 becomes progressively easier. Continued movement of handles 34 and 26 toward one another results in the complete removal of stud 12 as illustrated in FIG. 8. The tool 10 then can be moved into its opened position to enable the driving shaft 28 to be readily removed from the aperture 18.

In summary, a hand tool is provided for urging an enlarged head of a metallic stud through an aperture in a rubber insulator. The tool includes a driver and a support that are pivotally mounted to one another. The driver is adapted to engage the enlarged head of the stud. The support includes a pair of spaced apart arms and first and second support surfaces. The first support surface of the support member is disposed to be approximately perpendicular to the driving shaft of the driver when the tool is in its maximum opened condition. The second support surface is disposed to be approximately perpendicular to the driving shaft when the tool is in its closed condition. In use, the tool is opened to its maximum dimension and the first support surface is placed in contact with the insulators, such that the arms thereof are disposed on opposite sides of the stud. The driving shaft then is placed in contact with the enlarged head of the stud. The tool is gradually closed such that the driving shaft urges the enlarged head through the insulator. The initial angular alignment of the driving shaft to the aperture in the insulator facilitates the initial entry of the enlarged head into the aperture. Continued closing of the tool forces the stud through the aperture. As the movement of the stud through the insulator becomes more difficult due to the changed angular alignment of the driving shaft to the aperture, the tool can be repositioned such that the second support surfaces of the support member are placed against the insulator. In this changed angular relationship, the driving shaft will continue to force the stud through the insulator enabling complete removal thereof.

While the invention has been described with respect to a preferred embodiment, it is obvious that various changes and modifications can be made therein without departing from the spirit of the invention which should be limited only by the scope of the apended claims.

What is claimed is:

1. A tool for forcing an enlarged head of a vehicular exhaust system mounting stud from a vehicular exhaust system rubber insulator, said tool comprising:

en elongated driver having a driving shaft at one end thereof; and an elongated support having opposed ends, one said end of said support being pivotally mounted to said driver at a location thereon spaced from the driving shaft such that the other said end of said support is rotatable toward and away from the driving shaft, the other end of said support including a pair of spaced apart arms, each said arm defining a first supporting surface and a pair of spaced apart second supporting surfaces, said supporting surfaces being on the sides of said arms nearest the driving shaft, the first supporting surface of each said arm being disposed intermediate the spaced apart second supporting surfaces thereof, said first supporting surfaces lying in a first plane and said second supporting surfaces lying in a second plane angularly aligned with respect to the first plane, said first and second supporting surfaces being aligned such that when said support is rotated away from said driving shaft the first surfaces of said arms are approximately perpendicular to said driving shaft and such that when said support is rotated toward the driving shaft the second surfaces of said supporting arms are generally perpendicular to said driving shaft.

2. A tool as in claim 1 wherein the end of said driver opposite said driving shaft defines a handle.

3. A tool as in claim 2 further including a second handle pivotably mounted to said support.

4. A tool as in claim 3 wherein said second handle is pivotally mounted to said support at a location thereon spaced from the pivot of said support to said driver.

5. A tool as in claim 4 further including a connecting link pivotally mounted to both said driver and said second handle such that said link controls the pivotal movement of said support relative to said driver and said second handle.

6. A tool as in claim 5 wherein said driving shaft and said arms are spaced apart at least 1.5 inches when said support is rotated its maximum amount from said driver.

7. A tool as in claim 3 wherein the pivotal mounting of said support to said second handle is about one inch from the pivotal mounting of said support to said driver.

8. A tool as in claim 1 wherein said driving shaft is generally annular in cross section.

9. A tool as in claim 1 wherein said driving shaft is removably mounted to said driver.

10. A tool as in claim 1 wherein when the support is rotated its maximum distance from the driver, the first supporting surfaces are about 15° to 30° beyond a perpendicular alignment with the driving shaft.

* * * * *